US011141336B2

(12) United States Patent
Marshall

(10) Patent No.: US 11,141,336 B2
(45) Date of Patent: Oct. 12, 2021

(54) BEDPAN ASSEMBLY WITH LINER ATTACHMENTS

(71) Applicant: Neowe, Inc., Doral, FL (US)

(72) Inventor: Michelle Marshall, Doral, FL (US)

(73) Assignee: NEOWE, INC., Miami, FL (US)

( * ) Notice: Subject to any disclaimer, the term of this patent is extended or adjusted under 35 U.S.C. 154(b) by 0 days.

(21) Appl. No.: 16/646,852

(22) PCT Filed: Jul. 18, 2019

(86) PCT No.: PCT/US2019/042395
§ 371 (c)(1),
(2) Date: Mar. 12, 2020

(87) PCT Pub. No.: WO2020/018786
PCT Pub. Date: Jan. 23, 2020

(65) Prior Publication Data

US 2020/0405559 A1 Dec. 31, 2020

Related U.S. Application Data

(60) Provisional application No. 62/699,783, filed on Jul. 18, 2018, provisional application No. 62/810,031, filed on Feb. 25, 2019.

(51) Int. Cl.
*A61G 9/00* (2006.01)

(52) U.S. Cl.
CPC ..... *A61G 9/003* (2013.01)

(58) Field of Classification Search
CPC ..... A61G 9/003; A47K 11/00; A47K 11/02–023; B65F 1/06–062
See application file for complete search history.

(56) References Cited

U.S. PATENT DOCUMENTS 3,383,712 A * 5/1968 Grant ..... A61G 9/003 4/452
4,175,604 A 11/1979 Bonner
4,633,536 A * 1/1987 Tribble-DuBose .... A47K 11/02 4/460
5,155,871 A * 10/1992 Sams ..... A47K 11/06 108/132
5,644,799 A 7/1997 Armenta et al.
(Continued)

*Primary Examiner* — David P Angwin
*Assistant Examiner* — Nicholas A Ros
(74) *Attorney, Agent, or Firm* — Mark C. Johnson; Johnson Dalal

(57) ABSTRACT

A bedpan assembly with a portable bedpan housing with a sidewall and a bottom wall surrounded by the sidewall, the sidewall and bottom wall defining an enclosed housing interior cavity and the sidewall having a front end, a rear end, opposing sides, and defining a plurality of enclosed sidewall apertures each respectively disposed proximal to the front end of the sidewall and proximal to each of the opposing sides of the sidewall. The bedpan assembly also includes a plurality of grommets each respectively disposed within one of the plurality of sidewall apertures, retained by the sidewall, and having a plurality of independently flexible flange members defining a plurality of tightly spaced flange member slits, the plurality of independently flexible flange members operably configured to independently flex within the one of the plurality of sidewall apertures and retain a liner within.

19 Claims, 5 Drawing Sheets

(56) References Cited

U.S. PATENT DOCUMENTS

| | | | | |
|---|---|---|---|---|
| 7,080,750 | B2 * | 7/2006 | Wein | B65F 1/062 220/495.01 |
| 7,641,835 | B2 * | 1/2010 | Ramsey | B65F 1/06 264/260 |
| 7,749,531 | B2 | 7/2010 | Booher | |
| 7,891,030 | B1 | 2/2011 | Sutton | |
| 8,303,554 | B2 | 11/2012 | Tsai | |
| 2005/0177934 | A1 * | 8/2005 | Host | A61G 9/003 4/450 |
| 2007/0289972 | A1 | 12/2007 | Wynn et al. | |
| 2008/0057534 | A1 | 3/2008 | Martin et al. | |
| 2008/0257889 | A1 * | 10/2008 | Kovacevich | B65F 1/08 220/495.11 |
| 2010/0263118 | A1 | 10/2010 | Tanguay et al. | |
| 2011/0185489 | A1 | 8/2011 | Partington | |
| 2014/0082832 | A1 | 3/2014 | Marshall | |
| 2014/0315241 | A1 | 10/2014 | Dobson et al. | |

* cited by examiner

100

2-2

1-1

BEDPAN ASSEMBLY WITH LINER ATTACHMENTS

CROSS-REFERENCE TO RELATED APPLICATION

This application is a national stage filing of International Application Number PCT/US19/42395, filed Jul. 18, 2019, which claims priority to U.S. Provisional Patent Application No. 62/699,783 filed on Jul. 18, 2018 and U.S. Provisional Patent Application No. 62/810,031 filed on Feb. 25, 2019, the entirety of both are incorporated by reference.

FIELD OF THE INVENTION

The present invention relates generally to bedpan assemblies, and, more particularly, relates to bedpan assemblies operably configured to retain a liner disposed within.

BACKGROUND OF THE INVENTION

Bedpans are utilized by many users or patients, and conventionally include a receptacle used for the toileting of a bedridden patient in a health care facility. Bedpans are usually made of metal, glass, ceramic, or plastic and can be used for both urinary and fecal discharge. For example, many diseases can confine a patient to bed, necessitating the use of bedpans, including Alzheimer's disease, Parkinson's disease, stroke, and dementia. Additionally, many patients may be confined to a bed temporarily as a result of a temporary illness, injury, or surgery, thereby necessitating the use of a bedpan. Bedpans may be positioned under the bedridden patient or in close proximity for use. Regardless the disease or application, bedpan assemblies are routinely required to be emptied and/or cleaned for subsequent use.

As such, some known bedpan assemblies have been designed for use with inner-surface coatings or materials that make the bedpan conducive for easier and more effective cleaning after use by a patient. These systems, however, do not completely solve the problem of reducing the time needed to clean and prepare the bedpan for subsequent use. In recent years, a bedpan liner has also been developed and is composed of recycled wood pulp (molded pulp), thereby making it designed more for single use and decreasing the risk of cross-contamination diseases. However, each of these disposable systems can be costly over a longer period of time a bedpan is needed. As an alternative to the recycled pulp liner is the plastic bedpan liner, which also creates a barrier between the waste and the bedpan. Some liners are made of biodegradable plastic and contain absorbent powder to eliminate splashing and spills. Liners are used in hospitals to decrease infection and can also be purchased and used for home health care.

However, none of the known bedpan assemblies or liners completely solve the problem of reducing the time needed to clean and prepare the bedpan for subsequent use. Therefore, a need exists to overcome the problems with the prior art as discussed above.

SUMMARY OF THE INVENTION

The invention provides a bedpan assembly with liner attachment that overcomes the hereinafore-mentioned disadvantages of the heretofore-known devices and methods of this general type and that effectively and efficiently retains a liner for use with a bedpan assembly.

With the foregoing and other objects in view, there is provided, in accordance with the invention, a bedpan assembly with liner attachments having a portable bedpan housing with a sidewall and a bottom wall surrounded by the sidewall, the sidewall and bottom wall defining an enclosed housing interior cavity and the sidewall having a front end, a rear end, opposing sides, and defining a plurality of enclosed sidewall apertures each respectively disposed proximal to the front end of the sidewall and proximal to each of the opposing sides of the sidewall. The assembly also includes a plurality of grommets each respectively disposed within one of the plurality of enclosed sidewall apertures, retained by the sidewall, and having a plurality of independently flexible flange members defining a plurality of tightly spaced flange member slits. The plurality of independently flexible flange members are operably configured to independently flex within the one of the plurality of enclosed sidewall apertures. The assembly also includes a flexible liner selectively removably coupled to the bedpan housing through a retained configuration with the plurality of grommets and with a liner bottom surface surrounded by a liner sidewall, wherein the liner bottom surface and liner sidewall are disposed within the enclosed housing interior cavity and defining an enclosed liner interior cavity for housing a fluid therein, the liner is disposed within the main housing interior cavity.

In accordance with a further feature of the present invention, the plurality of enclosed sidewall apertures are disposed within the main housing interior cavity.

In accordance with another feature of the present invention, the plurality of enclosed sidewall apertures includes at least one sidewall enclosed aperture disposed proximal to the rear end of the sidewall.

In accordance with yet another feature of the present invention, the plurality of enclosed sidewall apertures are disposed proximal to the front end, rear end, and opposing sides of the sidewall are disposed within the main housing interior cavity.

In accordance with another feature, an embodiment of the present invention includes the sidewall having a first plurality of enclosed sidewall apertures defined by one of the opposing sides of the sidewall and a second plurality of enclosed sidewall apertures defined by another of the opposing sides of the sidewall, wherein the first plurality of enclosed sidewall apertures facing the second plurality of enclosed sidewall apertures and the at least one sidewall enclosed aperture is disposed proximal to the rear end of the sidewall facing the sidewall enclosed aperture disposed proximal to the front end of the sidewall.

In accordance with an additional feature of the present invention, the first plurality of enclosed sidewall apertures, the second plurality of enclosed sidewall apertures, the sidewall aperture disposed proximal to the front end of the sidewall, and the sidewall enclosed aperture disposed proximal to the rear end of the sidewall are disposed within the main housing interior cavity.

In accordance with an exemplary feature of the present invention, the plurality of independently flexible flange members are operably configured to independently flex in a direction away from the main housing interior cavity.

In accordance with a further feature of the present invention, the plurality of grommets are of a deformable polymeric material and are selectively removably coupled to and retained by the sidewall.

In accordance with another feature, an embodiment of the present invention includes the sidewall having an inner surface defining, with the bottom wall of the sidewall, the enclosed housing interior cavity, wherein the flexible liner is of polymer-based material and contouring the inner surface of the sidewall when in the retained configuration with the plurality of grommets.

In accordance with yet another feature, an embodiment of the present invention also includes the sidewall having a terminal upper surface spanning a perimeter of the sidewall and defining a discontinuous recess spanning in a direction toward the bottom wall of the sidewall and spatially coupled to the enclosed housing interior cavity.

In accordance with another feature of the present invention, the plurality of grommets are disposed on the sidewall of the bedpan housing in a symmetrical configuration with respect to a longitudinal midplane spanning longitudinally through a centroid defined by the bedpan housing.

Also in accordance with the present invention a bedpan assembly with liner attachments is disclosed that includes a portable bedpan housing having a terminal upper surface, a substantially rigid sidewall and a bottom wall surrounded by the sidewall and having a terminal bottom surface opposing the upper terminal surface, wherein the sidewall and bottom wall defining an enclosed housing interior cavity and the sidewall having a front end, a rear end, opposing sides, and defining a plurality of enclosed sidewall apertures each respectively disposed proximal to the front end of the sidewall and proximal to each of the opposing sides of the sidewall. The portable main housing defines a maximum height separating the terminal upper surface and the terminal bottom surface, the maximum height less than approximately 6-8 inches. Assembly also includes a plurality of grommets each respectively disposed within one of the plurality of enclosed sidewall apertures, retained by the sidewall, and having a plurality of independently flexible flange members defining a plurality of tightly spaced flange member slits, wherein the plurality of independently flexible flange members are operably configured to independently flex within the one of the plurality of enclosed sidewall apertures.

In accordance with another feature, an embodiment of the present invention also includes a flexible liner selectively removably coupled to the bedpan housing through a retained configuration with the plurality of grommets and with a liner bottom surface surrounded by a liner sidewall, wherein the liner bottom surface and liner sidewall disposed within the enclosed housing interior cavity and defining an enclosed liner interior cavity for housing a fluid therein, the liner is disposed within the main housing interior cavity.

In accordance with another feature of the present invention, the plurality of grommets are disposed on the sidewall of the bedpan housing in a symmetrical configuration with respect to a longitudinal midplane spanning longitudinally through a centroid defined by the bedpan housing.

Although the invention is illustrated and described herein as embodied in a bedpan assembly with liner attachment, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the bedpan assembly, from a first end to a second end.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
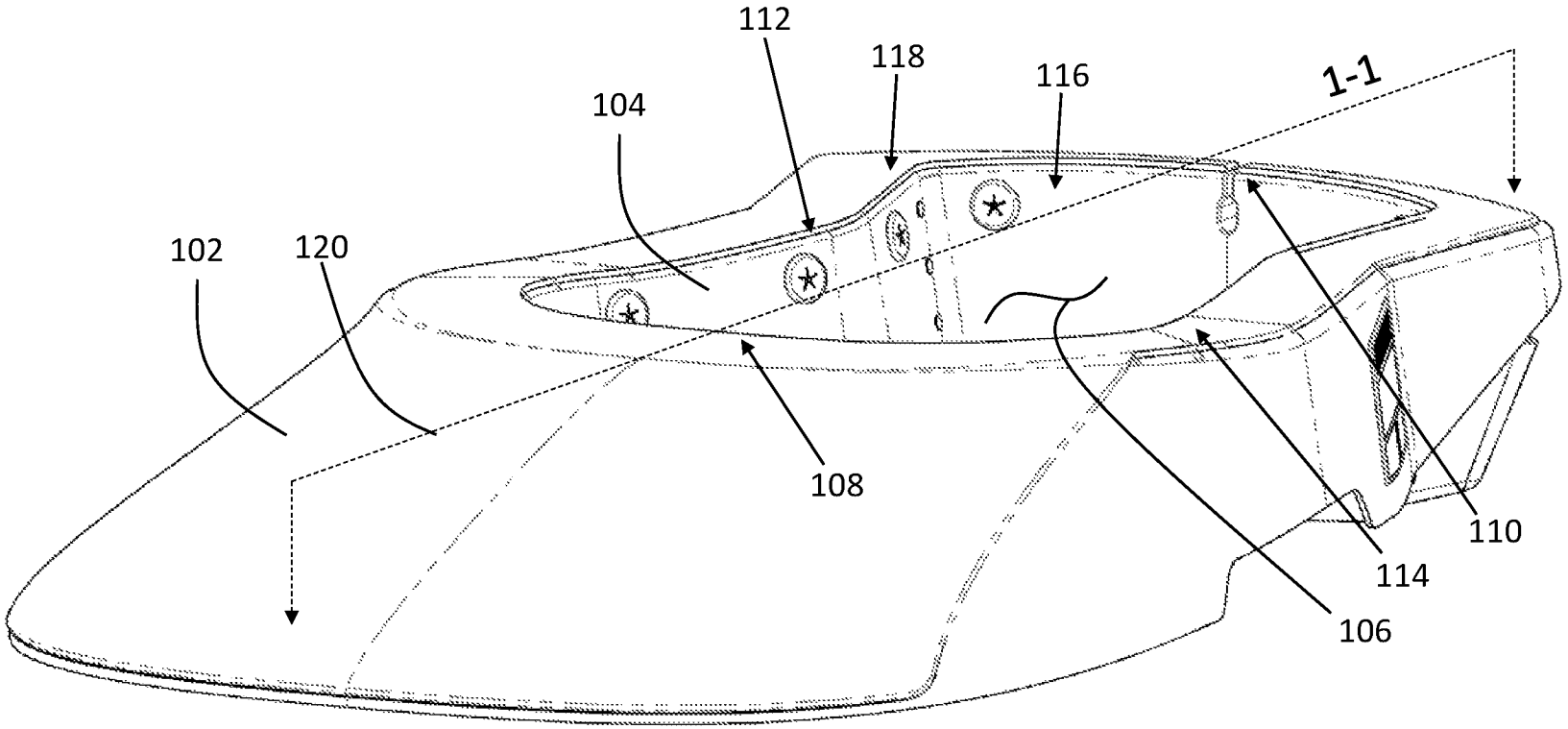
FIG. 1 is a perspective front view of a bedpan assembly with liner attachment in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 2:
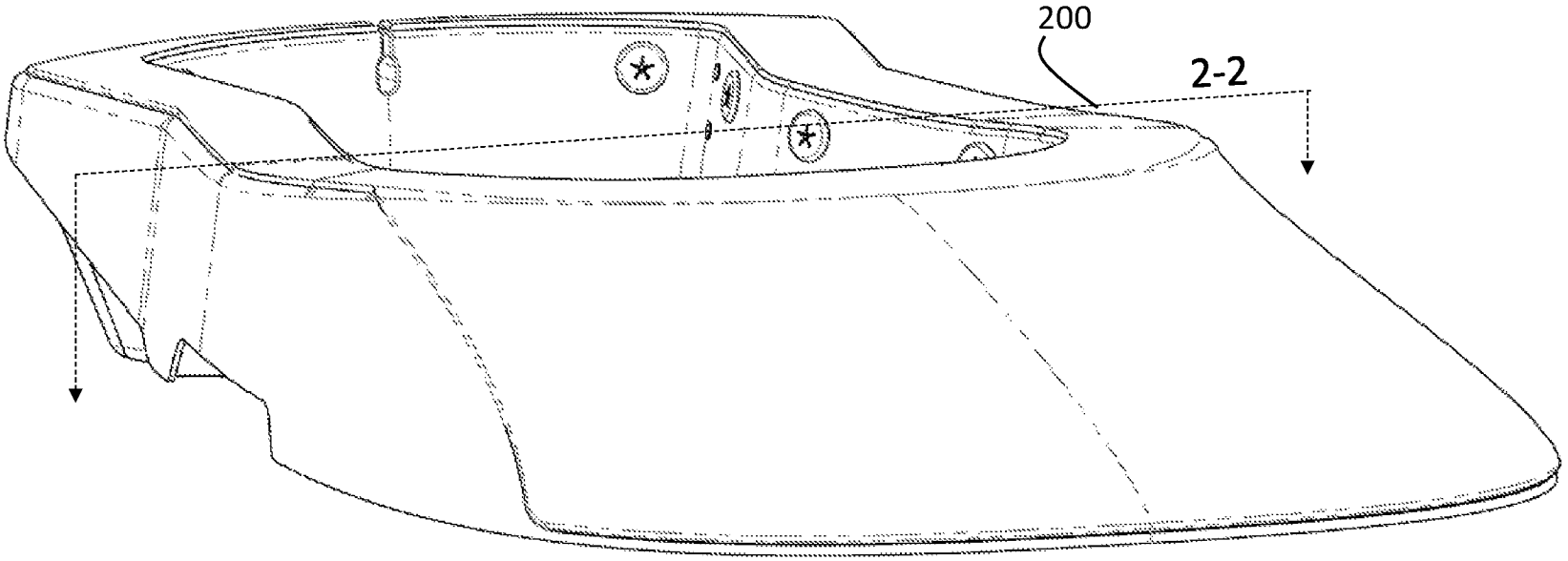
FIG. 2 is another perspective front view of the bedpan assembly depicted in FIG. 1.
Figure 7:
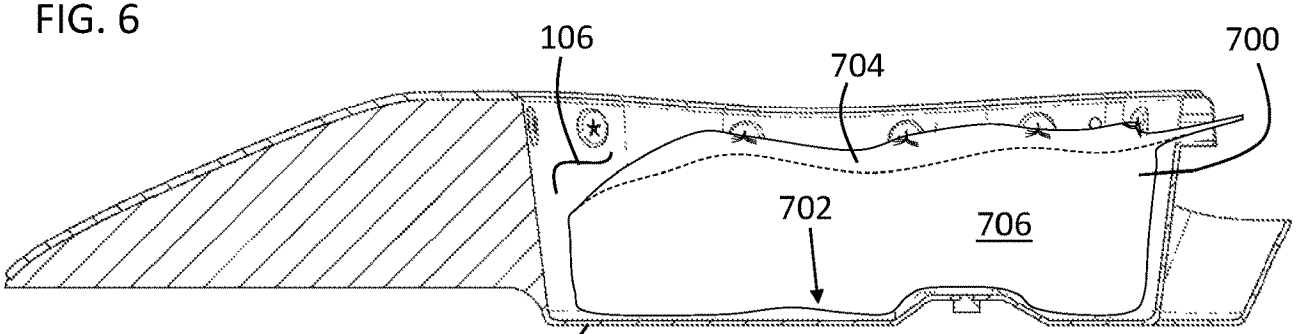
FIG. 7 is a cross-sectional view of the bedpan assembly depicted in FIG. 1 along section line 1-1.

Referring now to FIGS. 1-2 and FIG. 7, one embodiment of the present invention is shown in right and left front perspective views, respectively. FIGS. 1-2 and FIG. 7, along with other figures depicted herein, show several advantageous features of the present invention, but, as will be described below, the invention can be provided in several shapes, sizes, combinations of features and components, and varying numbers and functions of the components. The present invention provides a novel and efficient bedpan assembly with liner attachments 100. Embodiments of the invention provide a bedpan assembly 100 that is operably configured to retain a flexible liner, e.g., liner 700, for effective use with a bedpan, while simultaneously providing users quick and easy disposal of the liner when desired.

Figure 4:
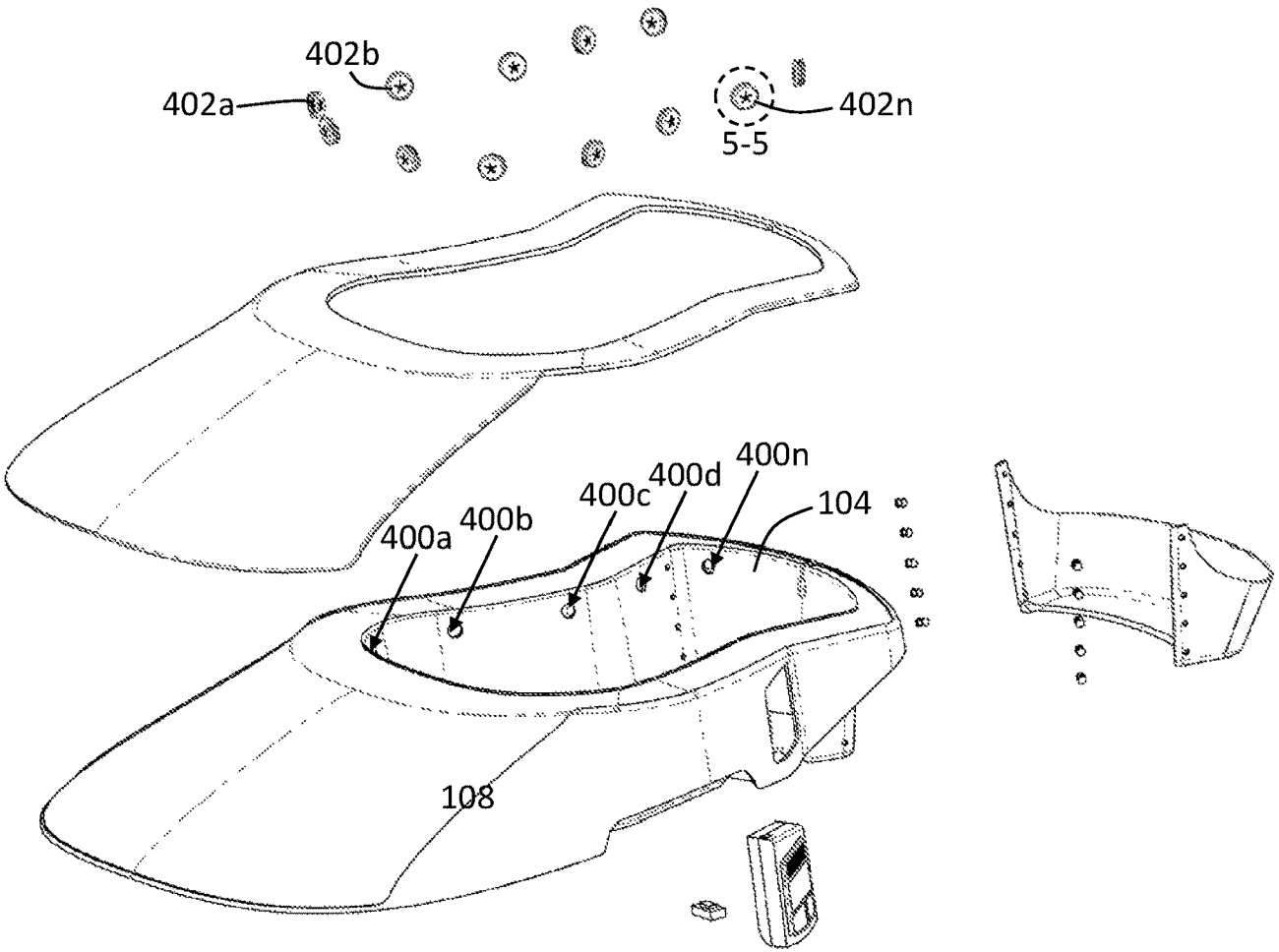
FIG. 4 is an exploded view of the bedpan assembly depicted in FIG. 1.

With reference now to FIG. 1, FIG. 4, and FIGS. 6-7, the bedpan assembly 100 includes a portable bedpan housing 102 having a sidewall 104 and a bottom wall 600 surrounded by the sidewall 600, wherein the sidewall 104 and bottom wall 600 can be seen defining an enclosed housing interior cavity 106 where the liner 700 will be placed to house and/or retain a user's fluid or other substance. The sidewall 104 has a front end 108, a rear end 110, opposing sides 112, 114, and defines a plurality of enclosed sidewall apertures 400*a-n*, wherein "n" represents any number greater than one. While FIG. 4 depicts apertures 400*a-n* on one side 112 and rear end 108 of the sidewall 104, other locations of the apertures 400*a-n* will be become apparent and appreciated upon reading the disclosure herein (e.g., there is an aperture located where any grommet is located).

It should be understood that terms such as, "front," "rear," "side," top," "bottom," and the like are indicated from the reference point of a viewer viewing the bedpan assembly 100 from its resting position on a ground surface, e.g., floor, bed, etc. Additionally, the term "wall" is intended broadly to encompass continuous structures, as well as, separate structures that are coupled together so as to form a substantially continuous external surface.

The apertures 400*a-n* are enclosed so that one of a plurality of grommets 402*a-n* can be inserted into one of the apertures 400*a-n* and retained by a sidewall 104 defining said aperture. As such, the sidewall 104 defining the apertures 400*a-n* may include recesses or other portions that are open, but yet still considered enclosed. The apertures 400*a-n* may be circular, having a diameter ranging from approximately 0.5-1.5 inches. In other embodiments, the apertures 400*a-n* may be of an oblong shape. The apertures 400*a-n* may each be respectively disposed proximal to the front end 108 of the sidewall 104 and proximal to each of the opposing sides 112, 114 of the sidewall 104. Said another way, the apertures 400*a-n* may each be respectively disposed at or near the front end 108, the opposing sides 112, 114, and/or the rear end 110 of the sidewall 104, whether located on an inner surface 116 of the sidewall 104 or on a terminal upper surface 118.

The portable bedpan housing 102 of the assembly 100 may be shaped, sized, and have material specifications akin to traditional bedpans. For example, the bedpan housing 102 may be of a relatively narrow and thin shape, have a length of approximately 1-2 feet, a width of approximately 6-24 inches, a height of approximately 3-9 inches, and of a metallic or polymeric material. In one embodiment, the main housing 102, which is portable, defines a maximum height separating the terminal upper surface 118 and the terminal bottom surface 602, the maximum height less than approximately 6-8 inches. In another embodiment, the terminal upper surface 118 may include a deformably resilient cushioning material, e.g., rubber, surrounding the perimeter of the housing 102 defining the enclosed opening spatially coupled to the housing interior cavity 106.

Figure 5:
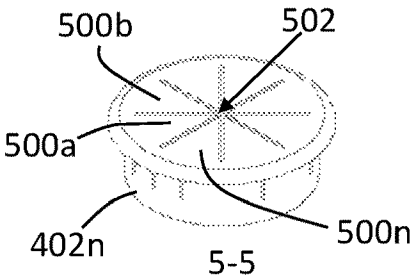
FIG. 5 is a perspective close-up view of an exemplary grommet in accordance with one embodiment of the present invention.

The plurality of grommets 402*a-n* each are respectively disposed within one of the plurality of enclosed sidewall apertures 400*a-n* and retained by the sidewall 104 (as best seen in FIG. 1). In one embodiment, the sidewalls of the plurality of grommets 402*a-n* are operably configured to be deformed to fit within the sidewall apertures 400*a-n*. Each of the plurality of grommets 402*a-n* may also include one or more flanges (vertically or horizontally configured on the grommet) to facilitate in retaining the plurality of grommets 402*a-n* on the sidewall 104 of the housing 102. With reference to FIGS. 4-5, each of the plurality of grommets 402*a-n* have a plurality of independently flexible flange members or fingers 500*a-n* defining a plurality of tightly spaced flange member slits 502*a-n* each disposed therein between the fingers 500*a-n*. The plurality of tightly spaced flange member slits 502*a-n* may be less than approximately 0.25 inches and may uniformly spaced as the flange member slit spans from a valley defined by the fingers 500*a-n* to the distal free end of the fingers 500*a-n*, also referred to herein as a "finger length". In preferred embodiments, the fingers 500*a-n* are directly adjacent to one another or define a 10-50 mil space separating them to effectively retain the flexible liner 700 (shown in FIG. 7). The grommets 402*a-n* may be made with a sheet of textile fabric, sheet metal, or composite of carbon fiber, wood, a deformable polymeric material, e.g., rubber, or honeycomb, and may be flared or collared on each side to keep them in place, and are often made of metal, plastic, or rubber.

The flexible flange members or fingers 500*a-n* may taper in width along the finger length. The plurality of independently flexible flange members 500*a-n* of each of the grommets 402*a-n* are operably configured to independently flex within the one of the plurality of enclosed sidewall apertures 400*a-n*. In one embodiment, the plurality of independently flexible flange members 500*a-n* may be of a substantially rigid polymeric material, e.g., polyurethane or polypropylene with a hardness of 20-50 Shore D. Each of the flexible flange members or fingers 500*a-n* may terminate at a free end, e.g., end 502. Each of the free ends may be positioned substantially adjacent to one another and collectively define, with all of the free ends, a center aperture. The flexible flange members or fingers 500*a-n* may have a static position with each substantially parallel to one another and may define a substantially planar upp surface. As the flexible flange members or fingers 500*a-n* are independently flexible to permit a liner to be inserted therethrough, they may also have a dynamic position with each flexed with respect to the static position. Said another way, the plurality of independently flexible flange members 500*a-n* are operably configured to independently flex in a direction away from and/or toward the main housing interior cavity 106. In one embodiment, the flexible flange members or fingers 500*a-n* are operably configured to be biased in the static position by mechanical action or by the inherent properties the material of the finger, namely the hinge formed thereon.

With reference to FIGS. 4-5 and FIG. 7, the flexible liner 700 is beneficially selectively removably coupled to the bedpan housing 102 through a retained configuration with the plurality of grommets 402. More specifically, as those of skill in the art can appreciate, the user will insert a portion of the liner 700 in each of the grommets 402*a-n* and, when the user releases the liner 700, two or more of the fingers 500*a-n* of the grommet will retain the liner 700 therein (as best shown in FIG. 7). The liner 700 will include a liner bottom surface 702 surrounded by a liner sidewall 704, wherein the liner bottom surface 702 and liner sidewall 704 are disposed within the enclosed housing interior cavity 106 and defining an enclosed liner interior cavity 706 for housing a fluid or other substance therein. The liner 700 is disposed within the main housing interior cavity 106 and may be inelastic or elastic. one embodiment, the liner 700 is of a low-density polyethylene (LDPE) resin. The liner 700 may also be constructed and arranged of another flexible and polymeric material. When the user desires to remove the liner 700, the user can easily, quickly, and effectively remove the liner by pulling on the liner 700 outwardly away from each grommet where the liner 700 is coupled.

With reference to FIG. 1 and FIGS. 4-7, the plurality of enclosed sidewall apertures 400*a-n* are disposed within the main housing interior cavity 106 and formed on an inner surface 116 of the sidewall 104, thereby minimizing the risk of inadvertent dislodgment by the user when resting on or being support by the housing 102. In other embodiments, the enclosed sidewall apertures 400*a-n* may be formed on the upper terminal surface 108 of the sidewall 104. The enclosed sidewall apertures 400*a-n* are also specially configured and position to minimize inadvertent dislodgment and adequately support the contents in which they house.

In one embodiment, the plurality of enclosed sidewall apertures 400*a-n* includes at least one sidewall enclosed aperture, with grommet disposed therein, disposed proximal to the rear end 110 of the sidewall 104, disposed proximal to the front end 108 of the sidewall 104, and disposed proximal to opposing sides 112, 114 of the sidewall 104, thereby providing sufficient support points to retain the liner 700 when inserted within the cavity 106. Proximal is defined as being positioned or located at or near, within approximately 1-4 inches, an object. In another embodiment, there are a first plurality of enclosed sidewall apertures 400*a-n* defined by one of the opposing sides 112, 114 of the sidewall 104 and a second plurality of enclosed sidewall apertures 400*a-n* defined by another of the opposing sides 112, 114 of the sidewall 104, wherein the first plurality of enclosed sidewall apertures are facing the second plurality of enclosed sidewall apertures to sufficiently retain and orient the liner 700 properly.

With reference to FIGS. 1-2 and FIG. 4, the location and configuration of the plurality of grommets 402*a-n* facilitates the flexible liner 700 in being adequately supported. while minimizing inadvertent removal. To that end, the location and configuration of the plurality of grommets 402*a-n* also enables the flexible liner 700 to contour the inner surface 116 of the sidewall 104 when in the retained configuration with the plurality of grommets 402*a-n*. In some embodiments, the plurality of grommets 402*a-n* are disposed on the sidewall 104 of the bedpan housing 102 in a symmetrical configuration with respect to a longitudinal midplane 120 spanning longitudinally through a centroid defined by the bedpan housing 120. In other embodiments, the plurality of grommets 402*a-n* are also disposed on the sidewall 104 of the bedpan housing 102 in a symmetrical configuration with respect to a traverse midplane 120 spanning transversely through a centroid defined by the bedpan housing 120. Additionally, two or more grommets 402*a-n* may also be disposed on the sidewall 104 in an equidistant configuration, e.g., approximately 2-3 inches, to adequate support a weight within the liner 700.

Figure 3:
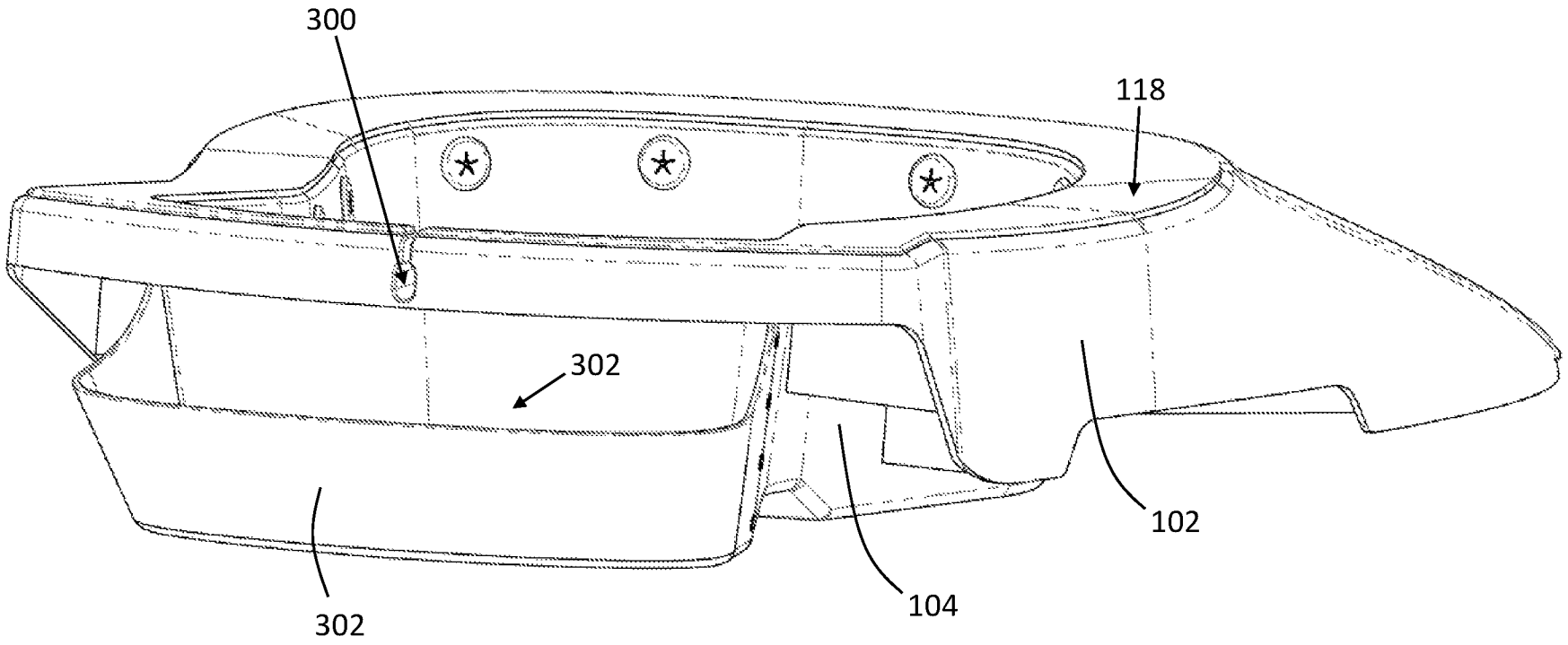
FIG. 3 is a perspective rear view of the bedpan assembly depicted in FIG. 1.
Figure 6:
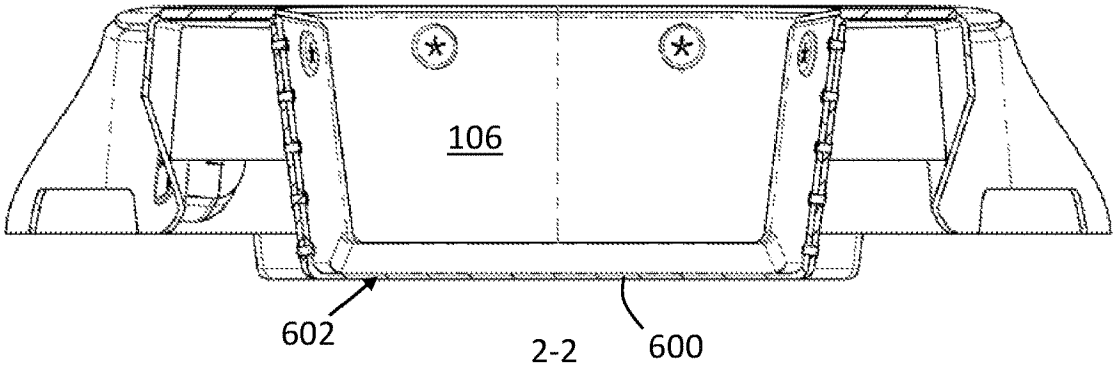
FIG. 6 is a cross-sectional view of the bedpan assembly depicted in FIG. 2 along section line 2-2.

As best seen in FIG. 3 and FIG. 6, the terminal upper surface 118 spans a perimeter of the sidewall 104 and defines a discontinuous recess and/or channel 300 spanning in a direction toward the bottom wall 600 of the sidewall and spatially coupled to the enclosed housing interior cavity 106. The recess and/or channel 300 provides an opening where a portion of the liner 700 may be inserted for easy access and removal by the user on an exterior of the housing 102. The assembly 100 may also include a liner storing container 302 with an upper opening 304 facing upwardly with respect to a ground surface supporting the housing 102. As its name implies, the liner storing container 302 is shaped and sized to retain a roll of liners for selective use by the user.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention. Additionally, while one or more method(s) of use and manufacture of the assembly 100 has been described, the order of executing the steps may be changed relative to the order shown or described in certain embodiments. Also, two or more steps shown in succession may be executed concurrently or with partial concurrence in some embodiments. Certain steps may also have been omitted for the sake of brevity. In some embodiments, some or all of the process steps can be combined into a single process.

What is claimed is:

1. A bedpan assembly with liner attachments comprising:

a portable bedpan housing having an internal sidewall with an inner surface, an external sidewall, and a bottom wall surrounded by the internal sidewall, the internal sidewall spanning upwardly from the bottom wall until reaching a ledge having a terminal upper surface disposed thereon and spanning a perimeter of the internal sidewall, the external sidewall extending downwardly from the terminal upper surface toward the bottom wall in an overlapping relationship with the internal sidewall, and the inner surface of the internal sidewall and bottom wall defining an enclosed housing interior cavity and the internal sidewall having a front end, a rear end, opposing sides, and defining a plurality of enclosed sidewall apertures spaced apart on the inner surface of the internal sidewall and with one of the plurality of enclosed sidewall apertures disposed at the front end of the internal sidewall, one of the plurality of enclosed sidewall apertures disposed at one of the opposing sides of the internal sidewall, and another of the plurality of enclosed sidewall apertures disposed at another of the opposing sides of the internal sidewall;

a plurality of grommets each respectively disposed within one of the plurality of enclosed sidewall apertures, retained by the internal sidewall, and having a plurality of independently flexible flange members defining a plurality of tightly spaced flange member slits, the plurality of independently flexible flange members operably configured to independently flex within the one of the plurality of enclosed sidewall apertures; and a flexible liner selectively removably coupled to the bedpan housing through a retained configuration with the plurality of grommets and with a liner bottom surface surrounded by a liner sidewall, the liner bottom surface and liner sidewall disposed within the enclosed housing interior cavity and defining an enclosed liner interior cavity for housing a fluid therein, the liner is disposed within the enclosed housing interior cavity.

2. The bedpan assembly according to claim 1, wherein:

the plurality of enclosed sidewall apertures are in fluid communication with the enclosed housing interior cavity.

3. The bedpan assembly according to claim 1, wherein:

the flexible liner is of polymer-based material and contouring the inner surface of the internal sidewall when in the retained configuration with the plurality of grommets.

4. The bedpan assembly according to claim 1, wherein the internal sidewall, ledge, and external sidewall further comprise:

a discontinuous recess defined thereon and spanning in a direction toward the bottom wall and spatially coupled to the enclosed housing interior cavity.

5. The bedpan assembly according to claim 1, wherein:

the plurality of grommets are disposed on the internal sidewall of the bedpan housing in a symmetrical configuration with respect to a longitudinal midplane spanning longitudinally through a centroid defined by the bedpan housing.

6. The bedpan assembly according to claim 1, wherein:

the plurality of independently flexible flange members are operably configured to independently flex in a direction away from the enclosed housing interior cavity.

7. The bedpan assembly according to claim 6, wherein:

the plurality of grommets are of a deformable polymeric material and are selectively removably coupled to and retained by the internal sidewall.

8. The bedpan assembly according to claim 1, wherein:

one of the plurality of enclosed sidewall apertures is disposed at the rear end of the internal sidewall.

9. The bedpan assembly according to claim 8, wherein:

the plurality of enclosed sidewall apertures are fluidly coupled to the enclosed housing interior cavity.

10. The bedpan assembly according to claim 8, wherein the internal sidewall further comprises:

a first plurality of enclosed sidewall apertures disposed at the one of the opposing sides of the internal sidewall and a second plurality of enclosed sidewall apertures disposed at another of the opposing sides of the internal sidewall, the first plurality of enclosed sidewall apertures facing the second plurality of enclosed sidewall apertures, the one of the plurality of enclosed sidewall apertures disposed at the rear end of the internal sidewall facing the one of the plurality of enclosed sidewall apertures disposed at the front end of the internal sidewall.

11. The bedpan assembly according to claim 10, wherein:

the first plurality of enclosed sidewall apertures, the second plurality of enclosed sidewall apertures, the one of the plurality enclosed sidewall apertures disposed at the front end of the internal sidewall, and the one of the plurality enclosed sidewall apertures disposed at the rear end of the internal sidewall are in fluid communication with the enclosed housing interior cavity.

12. A bedpan assembly with liner attachments comprising:

a portable bedpan housing having a rigid internal sidewall with an inner surface, a rigid external sidewall, and a bottom wall surrounded by the internal sidewall and having a terminal bottom surface opposing the upper terminal surface, the internal sidewall spanning upwardly from the bottom wall until reaching a ledge having a terminal upper surface disposed thereon and spanning a perimeter of the internal sidewall, the external sidewall extending downwardly from the terminal upper surface toward the bottom wall in an overlapping relationship with the internal sidewall, and the inner surface of the internal sidewall and the bottom wall defining an enclosed housing interior cavity and the internal sidewall having a front end, a rear end, opposing sides, and defining a plurality of enclosed sidewall apertures spaced apart on the inner surface of the internal sidewall and with one of the plurality of enclosed sidewall apertures disposed at the front end of the internal sidewall, one of the plurality of enclosed sidewall apertures disposed at one of the opposing sides of the internal sidewall, and another of the plurality of enclosed sidewall apertures disposed at another of the opposing sides of the internal sidewall, the portable bedpan housing defining a maximum height separating the terminal upper surface and the terminal bottom surface, the maximum height less than 8 inches; and a plurality of grommets each respectively disposed within one of the plurality of enclosed sidewall apertures, retained by the internal sidewall, and having a plurality of independently flexible flange members defining a plurality of tightly spaced flange member slits, the plurality of independently flexible flange members operably configured to independently flex within the one of the plurality of enclosed sidewall apertures.

13. The bedpan assembly according to claim 12, further comprising:

a flexible liner selectively removably coupled to the bedpan housing through a retained configuration with the plurality of grommets and with a liner bottom surface surrounded by a liner sidewall, the liner bottom surface and liner sidewall disposed within the enclosed housing interior cavity and defining an enclosed liner interior cavity for housing a fluid therein, the liner is disposed within the enclosed housing interior cavity.

14. The bedpan assembly according to claim 12, wherein:

the plurality of grommets are disposed on the internal sidewall of the bedpan housing in a symmetrical configuration with respect to a longitudinal midplane spanning longitudinally through a centroid defined by the bedpan housing.

15. The bedpan assembly according to claim 12, wherein:

the plurality of enclosed sidewall apertures are in fluid communication with the enclosed housing interior cavity.

16. The bedpan assembly according to claim 12, wherein:

the plurality of independently flexible flange members are operably configured to independently flex in a direction away from the enclosed housing interior cavity.

17. The bedpan assembly according to claim 12, wherein: one of the plurality of enclosed sidewall apertures is disposed at the rear end of the internal sidewall.

18. The bedpan assembly according to claim 17, wherein: the plurality of enclosed sidewall apertures are fluidly coupled to the enclosed housing interior cavity.

19. The bedpan assembly according to claim 17, wherein the internal sidewall further comprises:

a first plurality of enclosed sidewall apertures disposed at the one of the opposing sides of the internal sidewall and a second plurality of enclosed sidewall apertures disposed at another of the opposing sides of the internal sidewall, the first plurality of enclosed sidewall apertures facing the second plurality of enclosed sidewall apertures, the one of the plurality of enclosed sidewall apertures disposed at the rear end of the internal sidewall facing the one of the plurality of enclosed sidewall apertures disposed at the front end of the internal sidewall.

* * * * *